United States Patent [19]

Stöckel et al.

[11] 4,410,309

[45] Oct. 18, 1983

[54] METHOD OF MAKING A SPARK-PLUG CENTER ELECTRODE

[75] Inventors: Dieter Stöckel, Birkenfeld; Friedrich Schneider, Pforzheim, both of Fed. Rep. of Germany

[73] Assignee: G. Rau GmbH & Co., Pforzheim, Fed. Rep. of Germany

[21] Appl. No.: 226,171

[22] Filed: Jan. 16, 1981

[51] Int. Cl.[3] ..... H01T 21/02

[52] U.S. Cl. ..... 445/7; 228/155

[58] Field of Search ..... 29/25.12, 25.14; 228/155; 219/58; 445/7

[56] References Cited

U.S. PATENT DOCUMENTS 2,784,297 3/1957 Pityo ..... 219/58
2,955,222 10/1960 Beesch ..... 29/25.12
3,431,614 3/1969 Hallauer et al. ..... 29/25.12
3,857,145 12/1974 Yamaguchi et al. ..... 29/25.12

FOREIGN PATENT DOCUMENTS 754591 8/1956 United Kingdom .
1425126 2/1976 United Kingdom .

*Primary Examiner*—K. J. Ramsey
*Attorney, Agent, or Firm*—Wenderoth, Lind & Ponack

[57] ABSTRACT

A spark plug center electrode comprises a core of material having good thermal conductivity surrounded by a sheath of corrosion resisting material. During manufacture of the electrode, the core is joined to the sheath by means of a welded joint which extends only over the zone of the inner basal surface of the sheath part.

4 Claims, 3 Drawing Figures

METHOD OF MAKING A SPARK-PLUG CENTER ELECTRODE

BACKGROUND OF THE INVENTION

This invention relates to a method of making a spark-plug centre electrode of the type comprising a composite body made up of a sheath part in the form of a hollow body of corrosion-resisting material which is open at one end, and a core, made of a material having good thermal conductivity, which is inserted into the hollow interior of the sheath part and is jointly shaped with the sheath part by plastic shaping to obtain the resultant composite body.

In German OS No. 22 38 283, there is described a method of producing spark-plug centre electrodes, etc. in which method a piece of metal in convex form and having good thermal conductivity, e.g. copper, is introduced into a piece of metal of corrosion-resisting material such as nickel, which is of concave form matching the shape of the other metal piece, and the assembly is plastically shaped by extrusion to provide the final form. The starting point for this method of production is formed by a drawable material which consists of a cup-shaped corrosion-resisting metal piece with a thermally conducting core inserted therein, and it is assumed that, if required, the two metal pieces can be joined together by brazing, welding, heat-diffusion, compression, calking, etc. The purpose of this joint is to produce a drawable material which can be readily handled and, after the two parts have been suitably joined, can be easily introduced into a cold-drawing die. The drawable material is then converted into rod form by cold drawing under pressure applied by a ram, so that a cold-drawn product is obtained that comprises a cap-shaped sheath part of corrosion-resisting material which surrounds a metal core having good thermal conductivity.

When testing spark-plug centre electrodes consisting of a sheath part and a core, it has been found that overheating causes rapid destruction of the centre electrode if a satisfactory specific transfer of heat is not possible between the sheath part and the heat conducting core, particularly in the zone of greatest generation of heat. A likewise known form of spark-plug centre electrode of this kind therefore comprises a brazed joint between the sheath part and the core, which joint is also extended to the zone of the inner basal surface of the sheath part. However, such brazed joints can be produced only with difficulty in closed-off cavities to give the required uniformity, and a brazed joint which is not free from pores and is not perfectly uniform over the entire zone of the inner basal surface leads to a build up of heat and therefore to rapid destruction of the centre electrode.

SUMMARY OF THE INVENTION

The present invention seeks to provide an improved method of making a spark-plug centre electrode of the type referred to in which heat is carried away efficiently even in the case of heavy thermal loading.

There is provided a spark-plug centre electrode comprising a composite body made up of a sheath part in the form of a hollow body of corrosion-resisting material which is open at one end, and a core made of a material having good thermal conductivity, which core is inserted into the hollow interior of the sheath part and is jointly shaped with the sheath part by plastic shaping to obtain the resultant composite body, the sheath part being joined to the core by means of a welded joint extending only over the zone of the inner basal surface of the sheath part.

The welded joint confined exclusively to the zone of the inner basal surface (the bottom zones of the inner side-walls being automatically involved in subsequent shaping of the intermediate product) results in absolutely perfect transference of heat from the maximally thermally loaded point of the sheath part of the centre electrode to the core having good thermal conductivity.

According to the method of the invention the spark-plug centre electrode is made by forming the composite body by deep-drawing a round cut from strip material, on to one face of which round are previously welded cut lengths of wire forming the core material.

The above method enables the spark plug electrodes to be produced in large numbers. Preferably, the material of the sheath part is made of nickel or a nickel alloy, and the core material is made of copper or of a suitable copper alloy.

In a continuous process involving the method of this invention, strip material from which the rounds are to be cut out is fed to a welding station, lengths of wire forming the continuously fed core material are individually vertically attached by resistance welding to this strip material at predetermined points at the middle zones of the rounds that are to be cut out, then, after the rounds, connected to the core material, have been stamped out, they are applied in cup-like form around the core material in a deep-drawing operation, and this intermediate product is plastically shaped for finally forming the wire-like spark-plug centre electrode.

An example of the method of this invention will now be described as follows:

In a continuous production method, material for the sheath part in the form of a nickel strip 13 mm. wide and 0.9 mm. thick is fed to a stamping machine which stamps out rounds, 11 mm. having a diameter of 11 mm. from this strip. Pieces of copper wire, 8.5 mm. long and 4 mm. in diameter are attached by resistance welding to the middle zone of each of the rounds as they move to the stamping machine where they are cut out. Welding is simply carried out by standing the advanced wire on end and thereafter the upstanding part is severed following formation of the welded joint. The resultant mushroon-shaped elements formed after stamping are then transferred into a deep-drawing tool in which the round is drawn around the core material into the form of a cup. Single-stage or multi-stage drawing or extrusion then takes place, and intermediate heat-treatment may be applied between each two stages.

BRIEF DESCRIPTION OF THE DRAWINGS

An embodiment of the invention is illustrated by way of example in the accompanying drawings, in which.

DETAILED DESCRIPTION OF THE INVENTION

Figure 1:
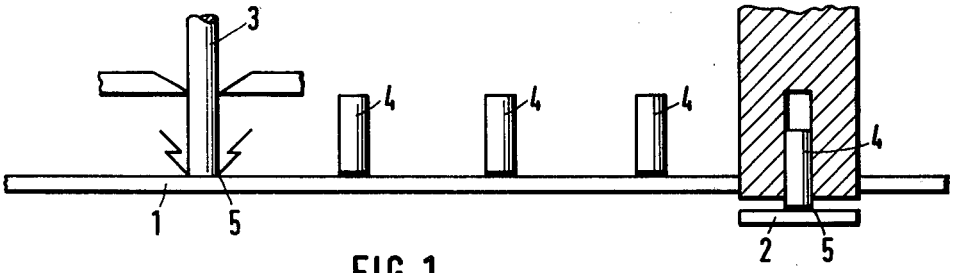
FIG. 1 illustrates diagrammatically various stages in the production method of the invention.

FIG. 1 shows a strip 1 of corrosion-resisting material from which rounds 2 are stamped. Prior to stamping, core material in the form of a copper wire 3 is welded on to each of the rounds near the centre point thereof, and the wire is then severed by a blade shear to form suitable cut lengths 4 of core. The copper wire 3 is connected to the rounds at a welding area 5 which, on completion of the shaping of each centre electrode, is disposed near the inner basal surface of the sheath part. After deep-drawing the product appears as shown in FIG. 2 wherein the round 2 forms a sheath of corrosion-resisting material which encloses the copper core 4.

Figure 2:
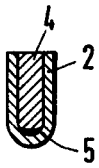
FIG. 2 illustrates an intermediate product.
Figure 3:
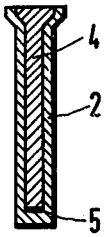
FIG. 3 is a longitudinal section, on an enlarged scale, through a spark-plug centre electrode (end product).

FIG. 3 shows the internal structure of the end product, after drawing or extrusion of the intermediate product shown in FIG. 2.

The features described above result in the provision of a spark-plug centre electrode which exhibits uniform and minimal burning loss and therefore has an extended service life. The manufacturing method described permits production involving the use of continuously fed strip and wire material and thus achieves considerable saving in costs as compared with the known method of producing spark-plug centre electrodes of this kind.

We claim:

1. A method of making a spark-plug center electrode comprising a composite body including a sheath part in the form of a hollow body of corrosion-resisting material which is open at one end and a core made of a material having good thermal conductivity, said method comprising:

welding a wire forming the core material to one face of a strip of the corrosion-resisting material;

cutting from said strip a round having welded thereto said wire;

deep drawing said round around said wire; and jointly plastically shaping said round and said wire to form said composite body.

2. A method according to claim 1, wherein said strip material from which said round is cut out is made of nickel or a nickel alloy, and said wire forming said core material is made of copper or a copper alloy.

3. A method according to claim 1, in the form of a continuous production process, comprising feeding to a welding station a continuous length of said strip, feeding a continuous length of said wire to said welding station, at said welding station resistance welding an end of said continuous length of said wire to said face of said continuous length of said strip, cutting said continuous length of said wire to define a cut length of wire welded to said strip, cutting said round from said strip, and repeating said operations of feeding said continuous length of said strip, feeding said continuous length of said wire, resistance welding, cutting said continuous length of said wire, and cutting said round, deep-drawing each said round around the respective said cut length of wire to form a cup-like body, and plastically shaping each said cup-like body and the respective said cut length of wire to finally form a wire-like spark-plug center electrode.

4. A method as claimed in claim 3, wherein the final plastic shaping comprises single or multi-stage drawing or extrusion.

* * * * *